United States Patent [19]

Faber et al.

[11] 3,976,850

[45] Aug. 24, 1976

[54] MULTIPLE PURPOSE PLUG ARRANGEMENT

[75] Inventors: Walter Faber, Munich; Gerhard Schmieg, Germering, both of Germany

[73] Assignee: Siemens Aktiengesellschaft, Berlin & Munich, Germany

[22] Filed: Mar. 11, 1974

[21] Appl. No.: 449,598

[30] Foreign Application Priority Data

Mar. 22, 1973 Germany ..... 2314419

[52] U.S. Cl. ..... 200/51.1; 317/101 DH

[51] Int. Cl.[2] ..... H01R 33/30

[58] Field of Search ..... 200/51.1, 51.11, 46, 200/61.19, 153 M; 339/176 MP, 184 M, 184 R

[56] References Cited

UNITED STATES PATENTS

| | | | |
|---|---|---|---|
| 1,658,832 | 2/1928 | Brown | 200/51.1 |
| 3,112,379 | 11/1963 | Holzer | 200/46 |
| 3,627,929 | 12/1971 | Vlijmen et al. | 200/51.1 |
| 3,818,280 | 6/1974 | Smith et al. | 339/184 M |

*Primary Examiner*—David Smith, Jr.

*Attorney, Agent, or Firm*—Hill, Gross, Simpson, Van Santen, Steadman, Chiara & Simpson

[57] ABSTRACT

A multiple purpose plug arrangement comprises an insulator housing wherein pairs of sheet metal strips form contact surfaces. The strips are bent so as to allow them to operate as rest contacts if desired. These rest contacts can be interrupted by a plug which may form a new circuit via the plug or simply interrupt the circuit via the rest contact. Thin insulator sheets permit the selective interruption of any one of the rest contacts.

2 Claims, 3 Drawing Figures

MULTIPLE PURPOSE PLUG ARRANGEMENT

BACKGROUND OF THE INVENTION

1. Field of the Invention

This invention is directed to a multiple purpose plug arrangement whose socket portion is designed so that it can be used as a rest contact, if desired when a plug has not been inserted, and further as a working contact for the plug member, after it has been inserted.

2. Prior Art

Multiple purpose plug arrangements are used in the art which comprise a plug whose opposite contacts are insulated from each other. Rest contacts in the socket portion, which are formed by pairs of springy contact sheet strips, are separated when the plug is inserted, and thus the circuit formed by the rest contact can be interrupted.

It has been found desirable for certain applications in communications to allow to selectively provide a working contact which was formed by the insertion of the plug; and to separate it by pulling this plug.

In addition, a non-costly versatile multiple purpose plug arrangement is desirable wherein the prior-art operation is possible to interrupt a working circuit or an operation where it provides a circuit or both.

SUMMARY OF THE INVENTION

The multiple purpose plug arrangement which is constructed in accordance with the principles of this invention allows an operation in a variety of manners. In addition to providing or interrupting a contact by means of the plug member at the end of the sheet strips forming the contact, it is also possible to selectively produce or interrupt a rest contact formed by inward bends of the sheet strips which are bent so as to contact one another by insulator sheets.

It is therefore an object of this invention to provide such a multiple purpose plug arrangement whereby the pairs of sheet metal strips are embedded in one end of the housing forming the socket part of the plug arrangement and extend freely into this socket part housing. At one point, these sheet strips are bent inwardly so as to form a rest contact. A further slight inward bend is provided farther down in this socket housing which serves as a working contact only if a plug member has been inserted, while the far ends of the sheet strips are outwardly bent so as to ensure an easy insertion of the plug. In this form, the circuit formed by the rest contact can be interrupted by inserting an interrupting plug or a different circuit can be provided via the plug.

This embodiment of the multiple purpose plug arrangement allows it to be a further object of this invention to selectively provide for a simple way of interrupting the rest circuits without the use of a disconnecting plug and to expand the use of a multiple purpose plug arrangement, while still allowing a circuit to be formed via a plug member. A thin insulator sheet is used to selectively interrupt this rest circuit.

It is a further object of this invention to produce these sheets in a simple and non-costly manner and such that they can be held in place in the multiple purpose plug arrangement in an easy manner. For this purpose, the insulator sheets are formed in a comb-like manner, extending from a somewhat thicker crosspiece. This crosspiece is fitted into the housing of the socket part, and the insulator sheets extending therefrom in the manner of prongs can be selectively removed where a rest contact is desired. These members may be easily produced by die-casting.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE PREFERRED EMBODIMENT

Figure 1:
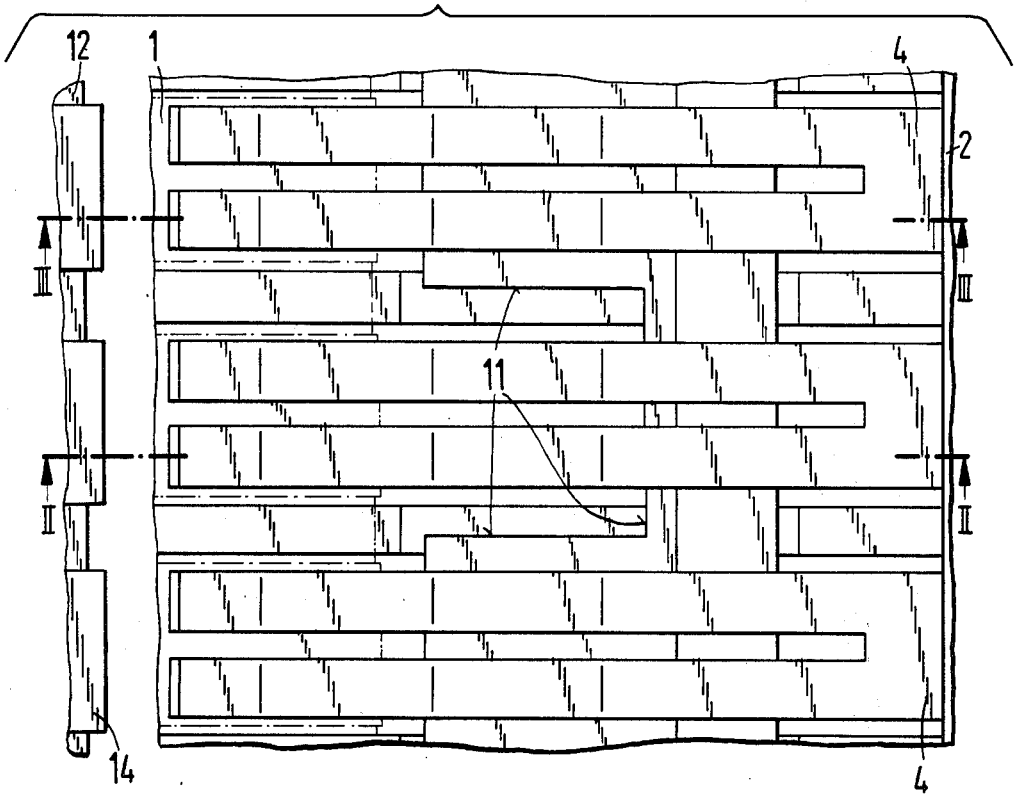
FIG. 1 is a strongly enlarged plan view of part of the multiple purpose arrangement seen from above, whereby the upper housing half of the socket housing has been removed, and whereby the plug member is also shown in part.

The drawings illustrate a multiple purpose plug arrangement according to this invention. A plastic housing 1 has been indicated only fragmentarily in FIG. 1, and it consists of two halves of essentially the same shape. Plastic ledges 2 and 3 serve for embedding rows of springy pairs of contact sheet strips 4. One member of these pairs 4 is respectively embedded in ledge 2, and the other one in ledge 3. These pairs of contact sheet strip show inward indentations 16 which provide the rest contact 13.

Another slight indentation 19 is provided close to the free end of the contact sheet strips 4, while the free end is flared outwardly to allow a perfect insertion of a plate-shaped plug 12. The distance between the slightly indented sections 19 of the contact sheet strips from one another and the thickness of the plate-shaped plug 12 are such that the rest contact 13 formed by the indentations 16 is interrupted when the plug 12 is inserted into the guide channel 17. This interrupts a circuit via the rest contact 13 and connects the contact sheet strips 4 the opposite contacts 14 of the plug 12. The plug may be part of a different circuit, or it may only interrupt the rest contact 13.

Figure 2:
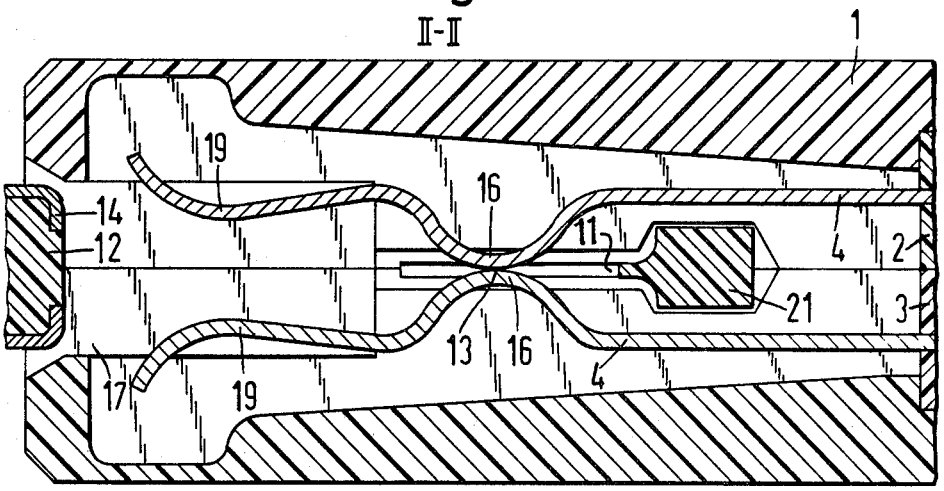
FIG. 2 is a section taken along line II—II of the arrangement according to FIG. 1.
Figure 3:
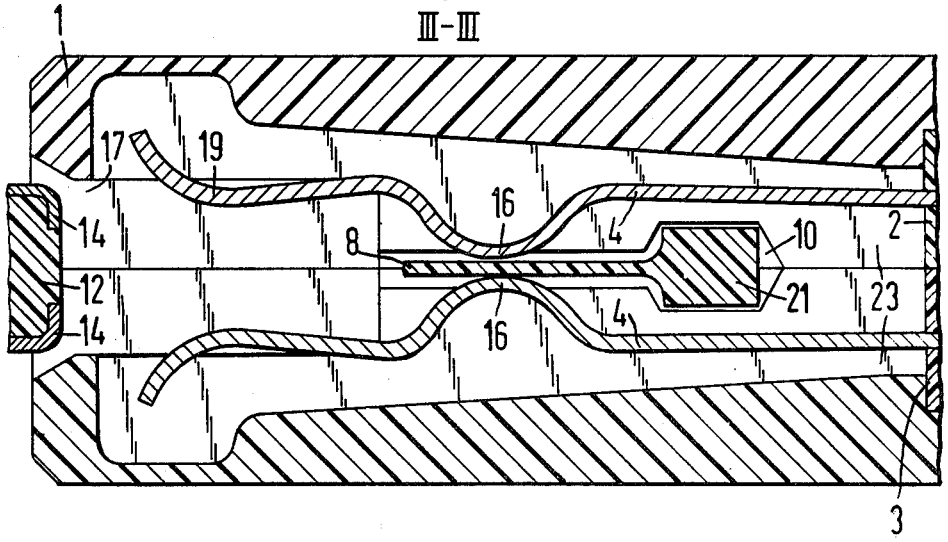
FIG. 3 is a section taken along line III—III of the arrangement according to FIG. 1.

If it is desired to use the arrangement according to FIG. 2 without obtaining a rest contact 13, an insulator material sheet 8 can be inserted between the inward indentations 16 forming the rest contact 13, as it has been shown in FIG. 3. In an advantageous manner, this insulator sheet is formed by die-casting in such a manner that a number of sheets are held together by a crosspiece 21 in a comb-like manner. A shaped recess 10 is provided within the housing, and it is formed by members 23 placed inside the housing 1. The sheet 8 is so thin that it does not separate the contact sheet strips as this would be the case if the plug 12 were inserted into the guide channel 17. A perfect contact is thus provided between the opposite contacts 14 of the plug 12, when it is inserted into guide channel 17.

The arrangement of FIG. 1 comprises inward indentations of both kinds, either forming rest contacts or not. This is due to the fact that the insulator-material sheets 8 are held together by the crosspiece 21, as described above, and some of these insulator-material sheets have been cut away as illustrated at 11 in FIGS. 1 and 2, thereby forming the rest contact 13.

It will be apparent from the above description of the preferred embodiments that this invention provides a simple, practical and effective multiple purpose plug arrangement which is as versatile as possible without incurring great cost. Although there may be variations and modifications made by those skilled in the art, it is desired to include these variations and modifications within the scope of this invention as defined in the appended claims.

We claim:

1. A multiple-purpose plug arrangement, comprising:

an insulator-material socket housing, said housing forming a plurality of opening means therein, each said opening means having a closed end and an entrance opposite thereto;

a plurality of pairs of elongated, flexible contact sheet spring strips arranged in said opening means of said housing, each strip of each of said pairs of spring strips having a first end, a contact surface, and a camming portion formed therein and spaced sequentially apart therealong, said ends of said pairs of said spring strips being secured in said closed end of said opening means of said housing, said contact surface of each said spring strip resiliently engaging the contact surface of the other strip of each said pair, said camming surfaces in each of said pairs being spaced from each other and forming a recess therebetween adjacent and directed towards said entrance of its respective said opening means;

a plug member selectively insertable into any one of said recesses of said pairs of contact spring strips, said plug member when moved into an operating position separating said contact surfaces of said one pair of spring strips by a distance;

a shaped recess provided in said insulator material housing and extending between said strips of each of said pairs of spring strips adjacent said contact surfaces thereof;

a cross-piece member arranged in said shaped recess; and at least one flat insulator member extending from said cross-piece member and disposed in said housing, each said flat insulator member having a thickness less than the distance separating said contact surfaces of said pair of contact spring strips when said plug member is inserted into said recess thereof.

2. A multiple purpose plug arrangement as defined in claim 1, wherein a plurality of said insulator members extend like comb teeth from said cross piece member, said comb tooth-like insulator member portions being selectively removable by detaching them from said cross piece member.

* * * * *